United States Patent [19]

Messersmith et al.

[11] Patent Number: 4,466,356

[45] Date of Patent: Aug. 21, 1984

[54] FULL DIAMETER HEAD SHIELD CONSTRUCTION FOR RAILWAY TANK CAR

[75] Inventors: Robert C. Messersmith; Richard B. Polley, both of St. Charles, Mo.

[73] Assignee: ACF Industries, Incorporated, New York, N.Y.

[21] Appl. No.: 227,122

[22] Filed: Jan. 22, 1981

[51] Int. Cl.[3] ..... B61D 5/00

[52] U.S. Cl. ..... 105/358; 105/5

[58] Field of Search ..... 105/358, 360, 361, 362, 105/394, 410, 421, 5, 6; 280/50; 220/68, 1 B; 293/126, 127; 213/220

[56] References Cited

U.S. PATENT DOCUMENTS

| | | | |
|---|---|---|---|
| Re. 19,537 | 4/1935 | Pierce | 105/358 |
| 3,308,769 | 3/1967 | Halcomb et al. | 105/362 |
| 3,467,027 | 9/1969 | Brown | 105/362 |
| 3,766,862 | 10/1973 | Heap et al. | 105/360 |
| 3,994,239 | 11/1976 | Baker et al. | 104/358 |

OTHER PUBLICATIONS

*Railway Age,* vol. 178, No. 6, Mar. 28, 1977, p. 30, "A Shield Kit Eases Retrofit of Tank Cars."

*Tank Car Specification,* E. I. Du Pont de Nemours and Co., Mar. 28, 1978, pp. 1–2, Exhibits A and B.

*Primary Examiner*—Robert B. Reeves

*Assistant Examiner*—Richard Mathieu

*Attorney, Agent, or Firm*—Henry W. Cummings

[57] ABSTRACT

A tank car head shield is generally arcuate and is located outboard of the tank. The shield extends upwardly from the center sill to the top portion of the tank and outwardly to protect the entire tank head. A head shield anchor extends generally horizontally from the shield to a location generally on the horizontal portion of the top of the tank, and circumferentially on either side of the tank and down to the center sill. The head shield anchor is continuous. First connecting means connect the head shield to an outer portion of the anchor outboard of the tank. Second connecting means connect an inner portion of the anchor to the tank. Third connecting means connect the shield and/or anchor to the center sill. In one embodiment the first connecting means comprises an angle welded to the anchor and to the head shield and the second connecting means comprises a pad welded to the anchor and to the tank. The anchor pad may be discontinuous. In another embodiment of the invention cushioning material is provided between the tank and head shield to cushion any impact loads applied to the shield.

21 Claims, 8 Drawing Figures

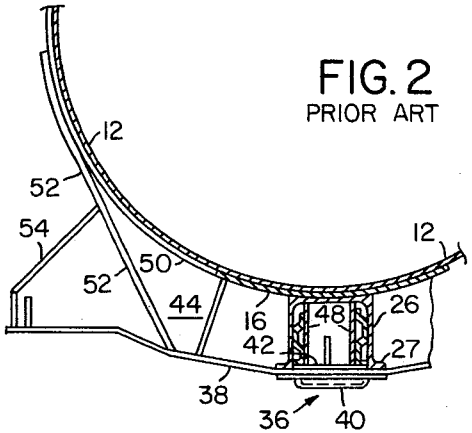
FIG. 2
PRIOR ART
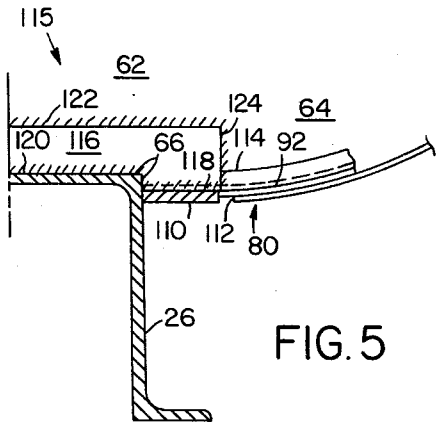
FIG. 5
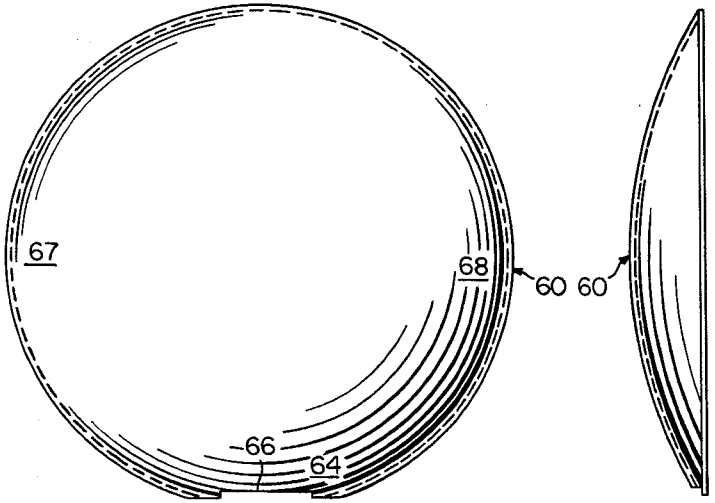
FIG. 4
FIG. 3

FULL DIAMETER HEAD SHIELD CONSTRUCTION FOR RAILWAY TANK CAR

BACKGROUND OF THE INVENTION

In U.S. Pat. No. 3,994,239 granted Nov. 30, 1976 and assigned to the assignee of the present application, a head shield extending part way up a railway tank car is disclosed which is adapted to be retrofitted to existing tanks without welding to the tank body. Thus stress relieving of the tank body is not required. A similar design is apparently also disclosed in Railway Age, page 30, Mar. 28, 1977, Vol. 178 No. 6. This patent and article and the references cited therein provide background information for the present invention.

New proposals in Docket No. HM-174 by the Federal Railroad Administration require a shield to extend to the top of the tank. The shield must be at least the size of the entire tank head of the tank car.

For new cars it has been proposed to weld a head shield extending approximately half way up the tank to the base of the tank. See Exhibits A and B found in the present application file. This requires stress relieving of the tank and the shield does not extend to the top of the tank as required by the proposed new FRA regulations, Docket No. HM-174. Furthermore location of the base of the shield to the tank prior to welding is difficult.

SUMMARY OF THE INVENTION

The object of the present invention is to provide a head shield construction in which the shield extends to the top of the tank and will be at least the size of the entire tank head.

Another object of the present invention is to provide a head shield which is relatively easily aligned with the tank structure to which it is attached.

A tank car head shield is generally arcuate and is located outboard of the tank. The shield extends upwardly from the center sill to the top portion of the tank, and outwardly on either side of the tank to protect the entire tank head. The head shield anchor is continuous. First connecting means connect the head shield to an outer portion of the anchor outboard of the tank. Second connecting means connect the head shield anchor to the tank. Third connecting means connect the shield and anchor to the sill. In one embodiment the first connecting means comprises an angle welded to the anchor and to the head shield and the second connecting means comprises a pad welded to the anchor and to the tank. The anchor pad may be discontinuous. In another embodiment of the invention cushioning material is provided between the tank and head shield to cushion any impact loads applied to the shield.

IN THE DRAWINGS

FIG. 2 is a vertical sectional view looking in the direction of the arrows along the line 2—2 in FIG. 1.

FIG. 3 is a front elevation view of a head shield which may be utilized according to the present invention.

FIG. 4 is a side elevation view of FIG. 3.

FIG. 5 is a partial vertical sectional view looking in the direction of the arrows along the line 5—5 in FIG. 1 and illustrating connection of the shield to the center sill.

DESCRIPTION OF PREFERRED EMBODIMENTS

Figure 1:
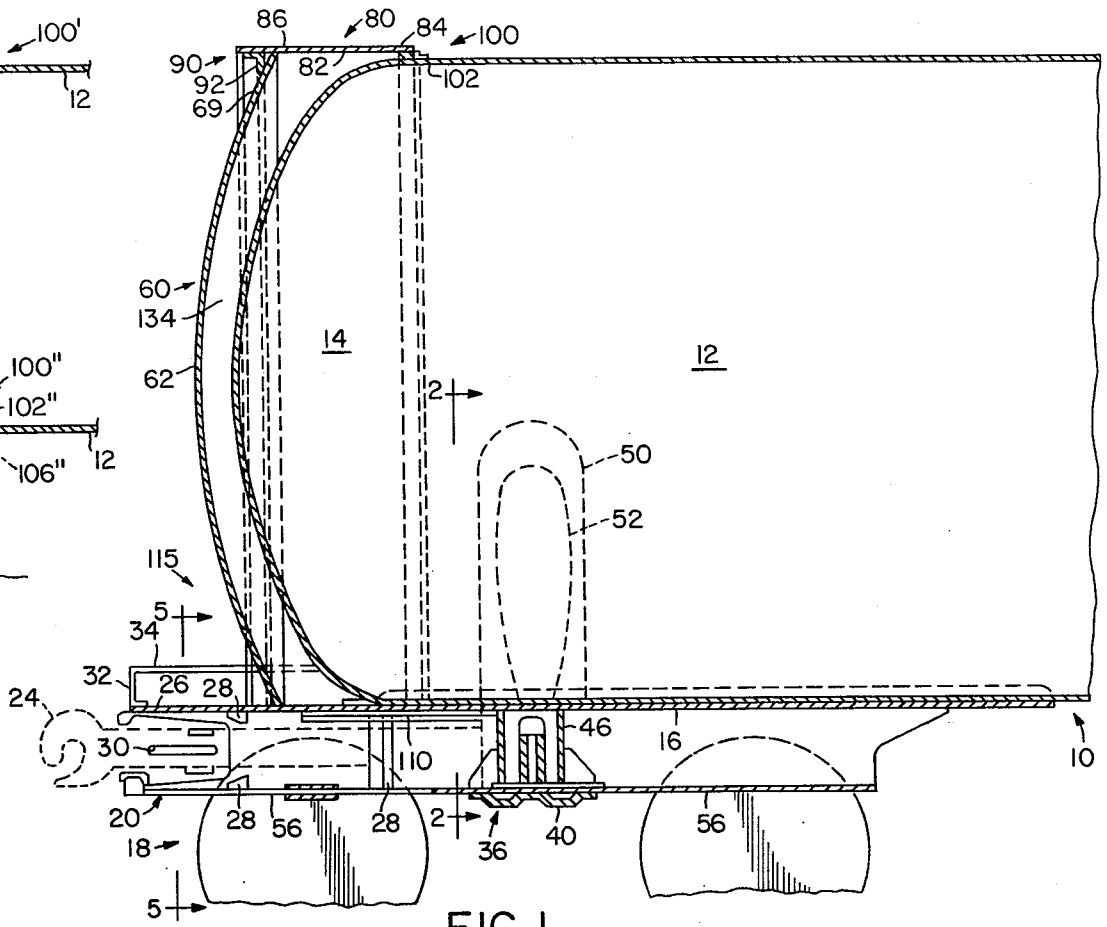
FIG. 1 is a vertical sectional view of the head shield assembly of the present invention.

Corresponding reference characters indicate corresponding parts throughout the several views of the drawings. In the drawings a railway tank car is indicated at 10. The tank car 10 includes a tank 12 having an end portion 14 which is generally arcuate. At either end the tank rests upon a cradle pad 16 supported by a truck 18 and an end stub sill 20 described in greater detail in U.S. Pat. No. 3,308,769 hereby incorporated into the present application by this reference. Briefly, an end stub center sill structure has a draft gear pocket adapted to receive a draft gear and coupler structure generally designated 24. As shown in FIG. 2, the end portion of stub center sill structure 20 forward of tank 12 comprises a pair of connected Z-shaped members forming a hat-shaped sill member 26 with lower flanges 27. Draft gear lugs 28 are secured to the inner surface of sill member 26 to provide stops for draft gear and coupler structure 24. A slot 30 in sill member 26 is adapted to receive a key for draft gear and coupler structure 24. An end sill 32 extends transversely across the width of car 10 and a stub side sill 34 extends between end sill 32 and shell 12 on each side of car 10.

Referring particularly to FIGS. 1 and 2, a bolster structure generally designated 36 has a lower cover plate 38 and a center plate 40 secured thereto adapted to receive the kingpin of an associated truck 14. A reinforcing plate 42 is positioned over cover plate 38. Extending across the width of car 10 are vertical bolster webs 44 and 46. Reinforcements 48 extend between webs 44 and 46 and outwardly from web 44 to adjacent stops 28.

A cradle pad or plate 50 is supported on sill member 26 and follows the outer contour of tank 12 to a position slightly below the horizontal centerline of tank 12. A side brace plate 52 on each side of tank 12 is secured along its upper edge to tank 12 and along its lower edge to bolster lower cover plate 38. A bolster outer cover plate 54 on each end of bolster structure 36 is secured to lower cover plate 38 along its lower edge and to plate 50 along its upper edge. As shown in FIG. 1, center sill structure 20 has a bottom cover plate 56 extending from bolster structure 36 to the inboard end of the sill member 26.

Arcuate cradle pad 16 is secured such as by welding, along its lower surface to center sill member 26. Cradle pad 16 extends inwardly beyond the inboard end of sill member 26 for a considerable distance as shown particularly in FIG. 1.

In accordance with the present invention, a head shield 60 is located outboard of the end portion of the tank 14. The head shield is generally circular in front elevation view and is generally arcuate in side elevation view as shown in FIGS. 3 and 4. The shield includes a body portion 62 and side portions 67 and 68 which extend to a point inboard of the outermost portion of the tank. At its base portion 64 the shield is cut out or coped at 66 to receive the sill 20.

A head shield anchor is indicated generally at 80. The anchor 80 comprises a plate 82 which extends from the head shield 60 inboard to a point located above the horizontal portion of the tank indicated at 84. In addition the plate 82 extends circumferentially around the tank.

First connecting means 90 connect the outer end 86 of the anchor to the upper end 69 of the shield. In one embodiment the first connecting means 90 comprise an angle 92 which is welded to the upper head shield portion 69 and to the outer anchor portion 86.

Second connecting means 100 connect the inner end of the anchor 84 to the tank portion 14. In one embodiment the second connecting means 100 comprise a pad 102 approximately ½ inch thick, which is welded to the tank end portion 14 and to which the inner end 84 of the plate 82 is welded.

It is within the scope of the present invention for the anchor pad 102 to be discontinuous at some locations, either horizontally at the top and/or in the circumferential portions.

Considering FIG. 5, it will be recalled that the shield 60 is cut away at the base portion 64 along the line 66, in the area of the stub sill 20. A sill reinforcing bar 110 is welded to the stub sill. It is seen in FIG. 5 that the anchor member 82 terminates at 112. Similarly, the connecting angle 92 terminates at 114.

Third connecting means 115 are provided to make a rigid connection of the head. A connecting plate 116 is provided to connect shield 60 and the anchor plate 80 to the sill. The mounting plate 116 is generally rectangular in shape and extends from the reinforcing bar 110 transversely of the car above the sill 26 to the reinforcing bar 110 on the other side. The plate 116 is welded to the reinforcing bar 110 as indicated at 118 and is welded to the stub sill as indicated at 120. The head shield 60 is welded to the plate 116 as indicated at 122. The angle 92 is welded to the plate 116 as indicated at 124. It is thus seen that the plate 116 provides a strong and rigid connection between the head shield 60 and the connecting angle 92 to the sill 26.

Inboard of plate 116, anchor 82 is welded to bar 110. Pad 100 is optionally welded to the underframe or bar 116.

It is to be born in mind that instead of a stub sill 26 and through sill (not shown) could be utilized with the same connecting arrangement.

Figure 8:
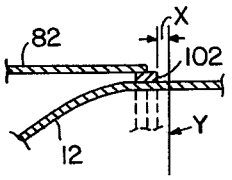
FIG. 8 is a vertical sectional view illustrating that the anchor and second connecting means are located outboard of the weld seam between adjacent courses.

Preferably, as shown in FIG. 8, the inner end of anchor 82 and pad 102 are located outboard of weld seam Y and distance X preferably of at least one (1) inch.

It is seen that the present invention provides greater protection to the tank inasmuch as the shield extends the entire distance from the center sill to the top of the tank.

Figure 6:
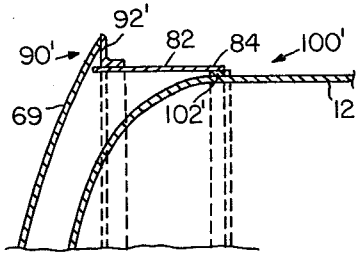
FIG. 6 is a view similar to the upper portion of FIG. 1 illustrating alternative first and second connecting means.

In another embodiment, FIG. 6, the first connecting means 90' comprise an angle 92' rotated relative to the angle 92. The angle 92' is welded to the upper portion 69 of the shield and to the anchor plate 82.

The second connecting means 100' in another embodiment may comprise a pad 102' thinner than the pad 52 (¼" thick) to which the inner end 84 of the anchor plate is welded.

Figure 7:
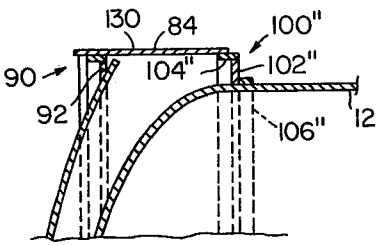
FIG. 7 is a view similar to FIG. 6 illustrating an alternative second connecting means.

In another embodiment, FIG. 7, the second connecting means 100" may comprise a Z-shaped pad 102" having an upper leg 104" to which the inner end 84 of the anchor is welded and a lower leg 106" which is welded to the tank end portion 14. The use of the Z-shaped pad 102" is somewhat less preferred than the pads 102 and 102' in that it is somewhat more difficult to roll into a circumferential shape. It has the advantage of providing separate legs to weld to the anchor 80 and the tank end 14.

It will be obvious to those skilled in the art that other first and second connecting means than those illustrated may be utilized. For example, the anchor may be directly welded to the upper end of the shield and the inner end of the anchor may be welded to the tank. Another alternative includes the use of mechanical fasteners for the first connecting means and/or for the second connecting means.

In accordance with another embodiment of the present invention, the anchor plate 80 and the first and second connecting means 90 and 100 are made continuous. However, one or more openings 130 are provided in the anchor 80 (FIG. 7). A cushioning material is then introduced through one or more openings 130 to provide a cushion between the tank end 14 and the shield 60. This cushioning material is indicated in the drawings at 134. This provides even greater protection for the tank 12.

An example of a suitable cushioning material 134 is polyurethane which may be foamed in place or foamed prior to application and inserted either through the openings 130 or applied prior to application of the shield 60 and the anchor 80. Other suitable cushioning materials will be apparent to those skilled in the art.

We claim:

1. A head shield assembly for railway tank cars having a bolster assembly comprising: a head shield located outboard of a tank located on a railway tank car; said head shield extending from a level adjacent a rail car center sill upwardly to a level adjacent the top of said tank; said shield further being acruate and extending at least partially around the end portion of said tank; an anchor member extending longitudinally inboard of said shield to a position above but adjacent to the top of said tank and not substantially further inwardly than said bolster assembly; said anchor further extending downwardly along each side of said tank to a position adjacent said sill and outboard of said bolster assembly; first connecting means integrally joining an outer portion of said shield to said anchor at least at positions located on the top portion of said shield and said anchor and at positions located on either side of said tank; second connecting means integrally joining the inboard portion of said anchor to said tank at positions located at the top of said tank and at positions located on either side of said tank at a location outboard of said bolster assembly; and third connecting means integrally joining the lower portion of said shield to said sill.

2. A head shield assembly according to claim 1, wherein said third connecting means include means for integrally connecting said anchor to said sill.

3. A head shield assembly according to claim 2, wherein said third connecting means include means for joining said first connecting means to said sill.

4. A head shield assembly according to claim 3, wherein said third connecting means include means for joining said second connecting means to said sill.

5. A head shield assembly according to claim 1, wherein said first connecting means comprises a first connecting angle welded to shield and to said anchor.

6. A head shield assembly according to claim 5, wherein said second connecting means comprises a connecting pad welded to said anchor and to said tank.

7. A head shield assembly according to claim 6, wherein said first connecting angle includes a low leg welded to said shield and an upper leg welded to said anchor.

8. A head shield assembly according to claim 6, wherein said first connecting angle includes a lower leg welded to said anchor and an upper leg welded to said shield.

9. A head shield assembly according to claim 4, wherein said second connecting means comprises a Z-shaped connecting member.

10. A head shield assembly according to claim 9, wherein said Z-shaped connecting member includes an upper horizontal leg welded to said anchor and a lower horizontal leg welded to said tank.

11. A head shield assembly according to claim 6, wherein said pad does not exceed one-half (½) inch in thickness above the horizontal top portion of said tank.

12. A head shield assembly according to claim 1, wherein said third connecting means comprises a sill plate integrally connected to said shield and to said sill.

13. A head shield assembly according to claim 12, wherein said shield is cut or coped in its base portion adjacent said sill.

14. A head shield assembly according to claim 13, wherein a sill reinforcing member is welded to said sill on either side thereof and wherein said sill plate is welded to said sill reinforcing member.

15. A head shield assembly according to claim 12, wherein said first connecting means is welded to said sill plate.

16. A head shield assembly according to claim 14, wherein said first connecting means is welded to said sill plate and to said reinforcing member.

17. A head shield assembly according to claim 15, wherein said anchor is welded to said reinforcing member.

18. A head shield assembly for railway tank cars having a bolster assembly comprising: a head shield located outboard of a tank located on a railway tank car; said head shield extending from a level adjacent a rail car center sill upwardly to a level adjacent the top of said tank; said shield further being arcuate and extending at least partially around the end portion of said tank to protect the entire tank head; an anchor member extending longitudinally inboard of said shield to a position above but adjacent to the top of said tank and not substantially further inwardly than said bolster assembly; said anchor further extending downwardly along each side of said tank to a position adjacent said sill and outboard of said bolster assembly; first connecting means integrally joining an outer portion of said shield to said anchor at least at positions located on the top portion of said shield and said anchor and at positions located on either side of said tank; second connecting means integrally joining the inboard portion of said anchor to said tank at positions located at the top of said tank and at positions located on either side of said tank at locations outboard of a railway tank car bolster assembly; third connecting means integrally joining the lower portion of said shield to said sill, and cushioning means located between said shield and said tank to absorb impact forces applied to said shield.

19. A head shield assembly according to claim 18, wherein said cushioning means comprises foam material located between said shield and said tank.

20. A head shield assembly according to claim 19, wherein said foam material is foamed in place between said shield and said tank.

21. A head shield assembly according to claim 19, wherein said first and second connecting means are continuous to prevent escape of said foam material.

* * * * *